US009059533B2

(12) United States Patent
Bogart et al.

(10) Patent No.: US 9,059,533 B2
(45) Date of Patent: Jun. 16, 2015

(54) LOCKOUT AND TAGGING DEVICE AND ASSEMBLY FOR A SWITCHABLE ENERGY ISOLATION DEVICE SUCH AS A TERMINAL BLOCK

(71) Applicant: DTE ELECTRIC COMPANY, Detroit, MI (US)

(72) Inventors: Edward J. Bogart, Wyandotte, MI (US); Stephen D. Longworth, Newport, MI (US); Joseph G. Elsesser, Wyandotte, MI (US)

(73) Assignee: DTE ELECTRIC COMPANY, Detroit, MI (US)

( * ) Notice: Subject to any disclaimer, the term of this patent is extended or adjusted under 35 U.S.C. 154(b) by 143 days.

(21) Appl. No.: 13/965,676

(22) Filed: Aug. 13, 2013

(65) Prior Publication Data

US 2014/0220802 A1 Aug. 7, 2014

Related U.S. Application Data

(60) Provisional application No. 61/760,061, filed on Feb. 2, 2013.

(51) Int. Cl.

| | |
|---|---|
| ***H01R 13/44*** | (2006.01) |
| ***H01R 13/46*** | (2006.01) |
| ***H01H 9/00*** | (2006.01) |
| *H01R 9/26* | (2006.01) |

(52) U.S. Cl.

CPC ..... *H01R 13/465* (2013.01); *H01H 9/00* (2013.01); *H01R 9/2633* (2013.01)

(58) Field of Classification Search

CPC .. H01R 13/60; H01R 2103/00; H01R 13/447; H01R 23/25; H01R 13/6397; H01H 9/28

USPC ..... 439/133; 200/43.19, 43.21

See application file for complete search history.

(56) References Cited

U.S. PATENT DOCUMENTS

| | | | | | |
|---|---|---|---|---|---|
| 1,021,550 | A | * | 3/1912 | Murray | 337/205 |
| 1,783,342 | A | * | 12/1930 | Reinhold | 439/133 |
| 1,906,929 | A | * | 5/1933 | Krueger | 439/133 |
| 1,943,692 | A | * | 1/1934 | Noyes | 439/133 |

(Continued)

OTHER PUBLICATIONS

Occupational Safety & Health Administraiton (OSHA); standard for The Control of Hazardous Energy (lockout/tagout); Title 29 Code of Federal Regulations (C.F.R.) Part 1910.147.

*Primary Examiner* — Abdullah Riyami
*Assistant Examiner* — Vladimir Imas
(74) *Attorney, Agent, or Firm* — Brooks Kushman P.C.

(57) ABSTRACT

A lockout and tagging device and assembly for a switchable energy isolation device such as a terminal block are provided. The lockout and tagging device includes a base member configured to support a tag and a male member extending from the base member and including a retaining portion complementary to a female receptacle of the isolation device to retain the male member in a female receptacle after insertion of the male member into the female receptacle. The lockout and tagging device also includes a blocking member extending from the base member. The blocking member positively blocks an actuator of the isolation device from moving and switching the isolation device into its non-isolating state when the male member is retained in the female receptacle. A circuit coupled to the isolation device is positively de-energized when the actuator is blocked in the isolating state.

20 Claims, 3 Drawing Sheets

(56) References Cited

U.S. PATENT DOCUMENTS

| | | | | | |
|---|---|---|---|---|---|
| 1,955,146 | A | * | 4/1934 | Reinhold | 439/133 |
| 1,998,129 | A | * | 4/1935 | Fullman | 439/133 |
| 2,051,169 | A | * | 8/1936 | Handschug | 439/133 |
| 2,075,256 | A | * | 3/1937 | Wood | 439/133 |
| 2,085,399 | A | * | 6/1937 | Thomson | 439/133 |
| 2,792,530 | A | * | 5/1957 | Wallace | 361/72 |
| 2,813,938 | A | * | 11/1957 | Speizman | 200/43.21 |
| 2,926,228 | A | * | 2/1960 | Date et al. | 335/34 |
| 3,018,350 | A | * | 1/1962 | Jensen | 337/189 |
| 3,129,992 | A | * | 4/1964 | Blonder | 439/133 |
| D201,375 | S | * | 6/1965 | Herrling | D15/17 |
| 3,197,581 | A | * | 7/1965 | Clifford | 200/43.21 |
| 3,271,530 | A | * | 9/1966 | Wirsching | 200/5 C |
| 3,408,466 | A | * | 10/1968 | Palmer | 200/43.21 |
| 3,467,763 | A | * | 9/1969 | Shaw | 174/67 |
| 3,518,597 | A | * | 6/1970 | Kussy et al. | 337/46 |
| 3,676,744 | A | * | 7/1972 | Pennypacker | 333/125 |
| 3,876,847 | A | * | 4/1975 | Dykes et al. | 200/400 |
| 4,044,215 | A | * | 8/1977 | Leibinger et al. | 200/318 |
| 4,288,838 | A | * | 9/1981 | Van Der Vegte et al. | 361/690 |
| 4,882,456 | A | * | 11/1989 | Hovanic et al. | 200/43.15 |
| 4,998,894 | A | * | 3/1991 | Gronvall | 439/521 |
| 5,011,422 | A | * | 4/1991 | Yeh | 439/307 |
| 5,063,817 | A | * | 11/1991 | Bogert | 477/125 |
| 5,071,360 | A | * | 12/1991 | Lindow et al. | 439/133 |
| 5,109,142 | A | * | 4/1992 | von Kannewurff et al. | 200/50.4 |
| 5,120,236 | A | * | 6/1992 | Gilbert | 439/133 |
| 5,139,429 | A | * | 8/1992 | Herman et al. | 439/133 |
| 5,148,910 | A | * | 9/1992 | Williams | 200/43.19 |
| 5,190,466 | A | * | 3/1993 | McVey | 439/304 |
| 5,191,968 | A | * | 3/1993 | McCurry | 200/43.11 |
| 5,304,753 | A | * | 4/1994 | Parrish et al. | 200/16 B |
| 5,322,980 | A | * | 6/1994 | Benda | 200/43.14 |
| 5,330,361 | A | * | 7/1994 | Brend | 439/134 |
| 5,398,530 | A | * | 3/1995 | Derman | 70/58 |
| 5,666,829 | A | * | 9/1997 | Aikens | 70/57 |
| 5,782,649 | A | * | 7/1998 | Aiken | 439/369 |
| 5,857,868 | A | * | 1/1999 | Findon et al. | 439/310 |
| 6,012,941 | A | * | 1/2000 | Burdenko et al. | 439/373 |
| 6,022,233 | A | * | 2/2000 | Daoud | 439/304 |
| 6,056,563 | A | * | 5/2000 | Betzler | 439/134 |
| 6,130,596 | A | * | 10/2000 | Yu | 337/50 |
| 6,184,595 | B1 | * | 2/2001 | Flegel, Jr. | 307/114 |
| 6,220,885 | B1 | * | 4/2001 | Lemberger et al. | 439/346 |
| 6,288,882 | B1 | * | 9/2001 | DiSalvo et al. | 361/42 |
| 6,469,264 | B2 | * | 10/2002 | Benda | 200/43.14 |
| 6,580,041 | B1 | * | 6/2003 | Ransopher | 200/43.21 |
| 6,724,618 | B1 | * | 4/2004 | Jenkins et al. | 361/679.32 |
| 6,727,441 | B2 | * | 4/2004 | Benda | 200/43.15 |
| 6,935,871 | B2 | * | 8/2005 | Maurer, Jr. | 439/133 |
| 6,949,994 | B2 | * | 9/2005 | Germain et al. | 335/18 |
| 7,084,725 | B2 | * | 8/2006 | Richter et al. | 335/18 |
| 7,098,761 | B2 | * | 8/2006 | Germain et al. | 335/18 |
| 7,275,941 | B1 | * | 10/2007 | Bushby | 439/133 |
| 7,302,752 | B2 | * | 12/2007 | Ball | 29/622 |
| 7,320,610 | B2 | * | 1/2008 | Boike | 439/121 |
| 7,320,611 | B2 | * | 1/2008 | Abbott | 439/133 |
| 7,397,652 | B2 | * | 7/2008 | Price et al. | 361/643 |
| 7,404,720 | B1 | * | 7/2008 | Frey et al. | 439/133 |
| 7,425,146 | B2 | * | 9/2008 | Valentin | 439/304 |
| 7,462,045 | B1 | * | 12/2008 | Lee | 439/133 |
| 7,497,705 | B2 | * | 3/2009 | Larson et al. | 439/133 |
| 7,507,096 | B1 | * | 3/2009 | Lee et al. | 439/133 |
| 7,551,047 | B2 | * | 6/2009 | Sokolow et al. | 335/6 |
| 7,717,716 | B2 | * | 5/2010 | Dahms | 439/63 |
| 7,868,719 | B2 | * | 1/2011 | Bazayev et al. | 335/18 |
| 7,956,301 | B2 | * | 6/2011 | Lankuttis et al. | 200/43.19 |
| 7,986,501 | B2 | * | 7/2011 | Kamor et al. | 361/42 |
| 8,198,558 | B2 | * | 6/2012 | Gregory et al. | 200/51 R |
| 8,525,372 | B2 | * | 9/2013 | Huang | 307/139 |
| 8,608,492 | B2 | * | 12/2013 | Cananzi et al. | 439/133 |
| 8,810,081 | B1 | * | 8/2014 | Flegel et al. | 307/328 |

* cited by examiner

LOCKOUT AND TAGGING DEVICE AND ASSEMBLY FOR A SWITCHABLE ENERGY ISOLATION DEVICE SUCH AS A TERMINAL BLOCK

CROSS-REFERENCE TO RELATED APPLICATIONS

This application claims the benefit of U.S. provisional Patent Application entitled "Electrical Lockout Device" filed Feb. 2, 2013 and having Application No. 61/760,061.

TECHNICAL FIELD

This invention relates generally to lockout and tagging devices and assemblies and, in particular, to lockout and tagging devices and assemblies for switchable energy isolation devices such as terminal blocks.

Overview

Different types of machinery in the workplace do their work by means of energy—electrical, mechanical, hydraulic, or pneumatic, etc. Releasing this energy makes the machines run. which is very useful, but not if the energy is released at the wrong time or if one is in the way.

There are many examples of people being seriously injured or killed by machinery and electrical equipment. Often, these tragedies happen because people carelessly try to repair or maintain the equipment without making sure its energy source has been shut off. Many times the accident happens when another worker restarts the machine, not knowing that another worker is in the machine. To prevent this type of tragedy, OSHA developed a standard that has very specific procedures for shutting off machinery, for making sure it cannot be operated after it has been shut off, and for warning employees to stay away from potential hazards. These procedures are called lockout/tagout.

The OSHA standard for *The Control of Hazardous Energy* (*Lockout/Tagout*), *Title* 29 *Code of Federal Regulations* (*C.F.R.*) *Part* 1910.147, addresses the practices and procedures necessary to disable machinery or equipment, thereby preventing the release of hazardous energy while employees perform servicing and maintenance activities. The standard outlines measures for controlling hazardous energies—electrical, mechanical, hydraulic, pneumatic, chemical, thermal, and other energy sources.

In addition, 29 C.F.R. 1910.333 sets forth requirements to protect employees working on electric circuits and equipment. This section requires workers to use safe work practices, including lockout and tagging procedures. These provisions apply when employees are exposed to electrical hazards while working on, near, or with conductors or systems that use electric energy.

The lockout/tagout standard establishes the employer's responsibility to protect employees from hazardous energy sources on machines and equipment during service and maintenance.

The standard gives each employer the flexibility to develop an energy control program suited to the needs of the particular workplace and the types of machines and equipment being maintained or serviced. This is generally done by affixing the appropriate lockout or tagout devices to energy-isolating devices and by de-energizing machines and equipment. The standard outlines the steps required to do this.

Lockout means much more than simply shutting of a machine by throwing a switch. When a machine has been locked out, it means:

all energy to the machine has been shut off (there may be more than one type of energy);

any energy that has been stored has been released or blocked; and the machine is literally locked out and cannot be restarted or released accidentally.

In lockout, a lock is placed on the part of the machine that controls the energy, such as a circuit breaker, switch, or valve. The lock itself cannot be used for any other purpose. That means you cannot use just any lock you might find in the workplace to perform a lockout—in fact, all lockout locks should be of the same general appearance so people can easily recognize them for what they are (for example, by color, brand, etc.). The lock must be strong and sturdy enough to stay in place until it is time for it to be unlocked.

Terminal blocks or strips such as terminal blocks of Phoenix Contact GmBH & Co. KG and others can be found in large numbers in electrical power plants. Such blocks or strips (boards) typically include an insulating base or slab equipped with one or more terminal connectors for the purpose of making electrical connections thereto. Many such blocks can switch according to different switching principles.

Such blocks or strips typically have 120 VAC or 130 VDC running through them to power instrumentation and control (I+C) equipment. Such equipment needs to be maintained and, consequently, the circuit on which the equipment is located needs to be de-energized prior to any such maintenance, to protect such workers. Such blocks may also include one or more female receptacles or jacks to receive a test plug of electronic test and measurement instruments to measure an electrical parameter of the circuit.

One possible way of de-energizing the circuit on which the equipment is located is to remove a wire or wires from the block. As shown in FIGS. 1 and 2, however, such removal often requires the worker to reach behind a row of such blocks and associated live wires to disconnect the wire thereby presenting a potentially dangerous situation.

Many terminal blocks are "switchable" to open the circuit without removing any wiring by having a slide or sliding link. As shown in FIGS. 3 and 4, a slide-type terminal block of Phoenix Contact has a captured slide nut between two connection screws. A screwdriver operates the slide. Test terminals are also provided as connections for test equipment to measure electrical parameters such as current, energy and voltage.

Also, as a way of providing a visual indication to others that the circuit was de-energized, a tag was often hung from live wiring to provide such visual indication. Ideally, it is desirable to hang such a tag form the terminal block. However, such terminal blocks typically do not provide a convenient location to hang such tags and, consequently, were oftentimes not hung. As a result, maintenance personnel often worked on equipment that was either not tagged or was energized. Neither situation was desirable.

SUMMARY

An object of at least one embodiment of the present invention is to provide a lockout and tagging device and assembly for an energy isolation device such as a switchable terminal block to improve the safety of workers who are performing routine service and maintenance tasks on equipment.

In carrying out the above object and other objects of at least one embodiment of the present invention, a lockout and tagging device for a switchable energy isolation device is provided. The isolation device has a female receptacle and a moveable actuator for switching the isolation device between isolating and non-isolating states. The lockout and tagging device includes a base member configured to support a tag and a male member extending from the base member and including a retaining portion complementary to the receptacle to retain the male member in the female receptacle after insertion of the male member into the female receptacle. The device also includes a blocking member extending from the base member. The blocking member positively blocks the actuator from moving and switching the isolation device into its non-isolating state when the male member is retained in the female receptacle. A circuit coupled to the isolation device is positively de-energized when the actuator is blocked in the isolating state of the isolation device by the blocking member.

The female receptacle may include a banana-type jack having a conductive sleeve with the internal bore and the male member may be a banana-type plug to provide a low-resistance compression fit with the jack.

The switch may include a control element slidable on a track having an opening. A distal end of the blocking member may extend into the opening to block the control element from moving from an open position to a closed position of the control element.

The distal end of the blocking member may be generally cylindrical wherein the opening is sized and shaped to allow the distal end to fit into the opening and block the control element in the open position.

The male and blocking members may have central axes which are substantially parallel to each other.

The base and blocking members may be made of a non-conductive material such as a laminated plastic material.

The blocking member and the base member may be integrally formed from the laminated plastic material.

The device may be a two-pronged device wherein the blocking and male members are prongs of the device.

The base member may include at least one aperture extending completely therethrough to receive a locking strip.

Further in carrying out the above object and other objects of at least one embodiment of the invention, a lockout and tagging assembly for a switchable, energy isolation device is provided. The device has a female receptacle and a movable actuator for switching the device between isolating and non-isolating states. The assembly includes a warning tag, a base member to suspend the tag and a male member extending from the base member and including retaining portion complementary to the receptacle to retain the male member in the receptacle after insertion of the male member into the receptacle. The assembly also includes a blocking member extending from the base member. The blocking member positively blocks the actuator from moving and switching the device into its non-isolating state when the male member is retained in the female receptacle. A circuit coupled to the device is positively de-energized when the actuator is blocked in the isolating state of the device by the blocking member. The tag provides a visual warning that the circuit has been de-energized and should not be energized.

The female receptacle includes a banana-type jack having a conductive sleeve with an internal bore and the male member may be a banana-type plug to provide a low-resistance compression fit with the jack.

The actuator includes a control element slidable on a track having an opening wherein a distal end of the blocking member extends into the opening to block the control element from moving from an open position to the closed position of the control element.

The distal end of the blocking member may be generally cylindrical wherein the opening is sized and shaped to allow the distal end to fit into the opening and block the control element in the open position.

The male and blocking members may have central axes which are substantially parallel to each other.

The base and blocking members may be made of a non-conductive material such as a laminated plastic material.

The blocking member and the base member may be integrally formed from the laminated plastic material.

The base member may have at least one aperture extending completely therethrough to receive a locking strip. The locking strip may support the tag from the base member.

The male and blocking members may form two prongs extending from one end of the base member.

Still further in carrying out the above object and other objects of at least one embodiment of the present invention, a lockout and tagging device for a switchable terminal block is provided. The block has a female receptacle with a pin-receiving internal bore and a switch that is actuated by moving a control element from an open position to a closed position. The device includes a base member configured to support a tag and a male pin member extending from one end of the base member and including at least one radially-resilient conductor portion complementary to the internal bore to lock the pin member in the female receptacle after insertion of the pin member into the female receptacle. The device also includes an electrically-insulating blocking member extending from the one end of the base member. The blocking member positively blocks the control element from moving from the open position to the closed position when the pin member is locked in the female receptacle. A circuit electrically coupled to the terminal block is positively de-energized when the control element is blocked in the open position.

The above objects and other objects, features, and advantages of the present invention are readily apparent from the following detailed description of the best mode for carrying out the invention when taken in connection with the accompanying drawings.

DETAILED DESCRIPTION OF EXAMPLE EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A lockout and tagging device for a switchable energy isolation device such as a terminal block is provided. The energy is typically electrical energy but may be mechanical, hydraulic, pneumatic, chemical, thermal, and other energy sources.

Figure 1:
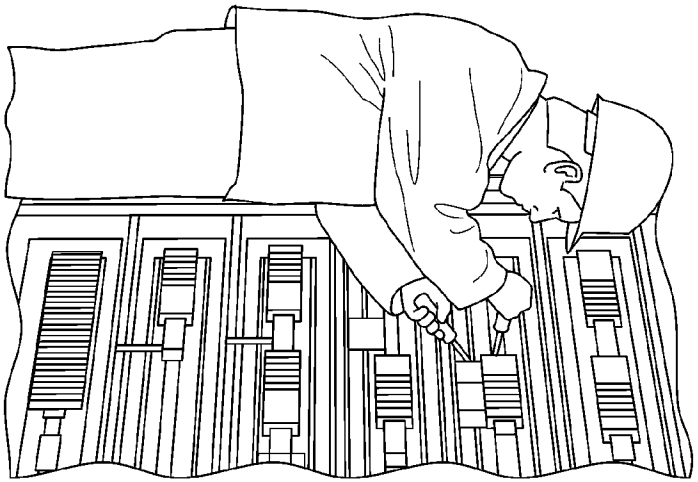
FIG. 1 is an environmental view showing a worker performing a service or maintenance task on a bank of terminal blocks in a control panel.
Figure 2:
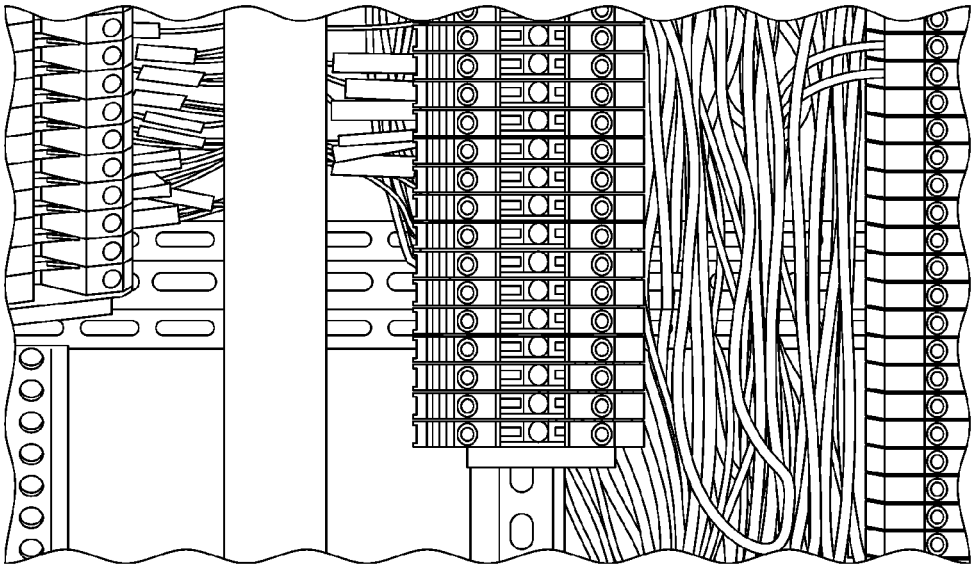
FIG. 2 is an enlarged view of a row of switchable terminal blocks and associated wiring to and down the blocks.
Figure 3:
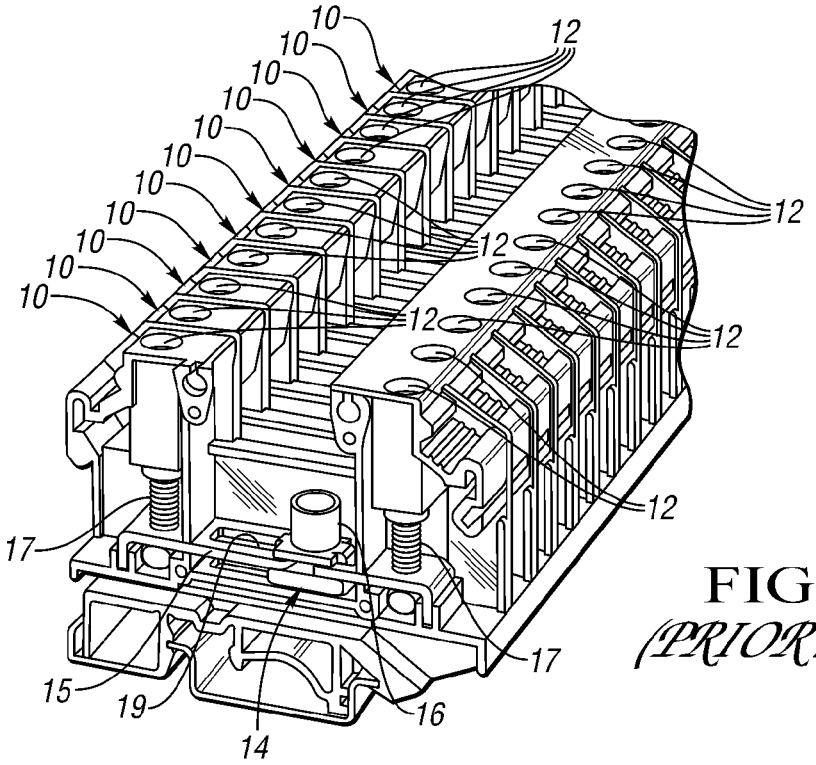
FIG. 3 (PRIOR ART)
FIG. 3 is an enlarged perspective view of an interconnected row of switchable terminal blocks.
Figure 4:
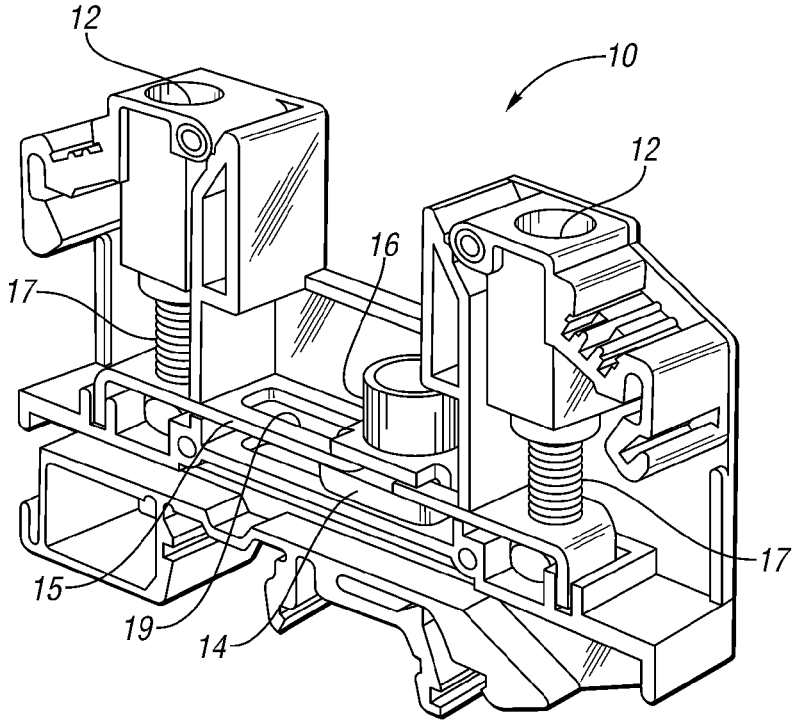
FIG. 4 (PRIOR ART)
FIG. 4 is an enlarged perspective view of a single, slidably-switchable terminal block.

Typically, a bank or a row of such blocks is provided in a power plant as shown in FIGS. 1, 2 and 3. An example block, generally indicated at 10 in FIG. 4, has a pair of female, receptacles 12 each of which has a pin-receiving internal bore and a switch 14 that is actuated by sliding a control element 16 of the switch 14 from an open position (not shown) to a closed position as shown in FIG. 4. The bore is formed in a conductive sleeve (not shown) which forms part of the receptacle 12. The receptacles 12 and their respective sleeves typically provide electrical connections for test and measuring equipment. The switch 14 includes a captive nut which slides on a rail or track 15 between connection screws 17 within an opening or slot 19 formed in the track 15.

Figure 5:
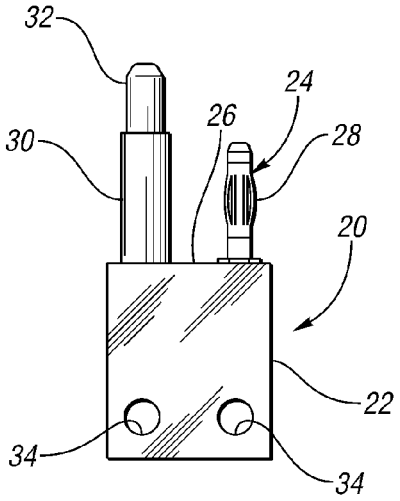
FIG. 5 is a side view of a lockout and tagging device constructed in accordance with at least one embodiment of the present invention.

Referring now to FIG. 5, the lockout and tagging device, generally indicated at 20, includes a base member 22 configured to support a warning tag 24. The device 20 also includes a conductive male pin member, generally included at 24, extending from one end of the base member 22 and including at least one radially-resilient conductor portion or retainer portion 28 complementary to the internal bore of the sleeve to positively lock or retain the pin member 24 in the female receptacle 12 after insertion of the pin member 24 into the female receptacle 12. The conductor portion 28 may include one or more resilient, longitudinally aligned, contact slats which are designed to resiliently expand radially outward as is well known in the art.

The device 20 further includes an electrically-insulating blocking member 30 extending from the one end 26 of the base member 22. The blocking member 30 positively blocks the control element 16 from moving from the open position to the closed position when the pin member 24 is positively locked in the female receptacle 12. A circuit (not shown) electrically coupled to the terminal block 10 is positively de-energized when the control element 16 is blocked in its open position as shown in FIG. 7.

The female receptacle 12 is preferably a banana-type jack having a conductive sleeve with the internal bore and the pin member 24 is preferably a banana-type plug to provide a low-resistance compression fit with the jack.

The switch 14 is preferably a slide switch wherein the control element 16 slides on the track 15 having the opening 19. A distal end 32 of the blocking member 30 extends into the opening 19 to block the control element 16 from moving from its open position to the closed position.

Figure 7:
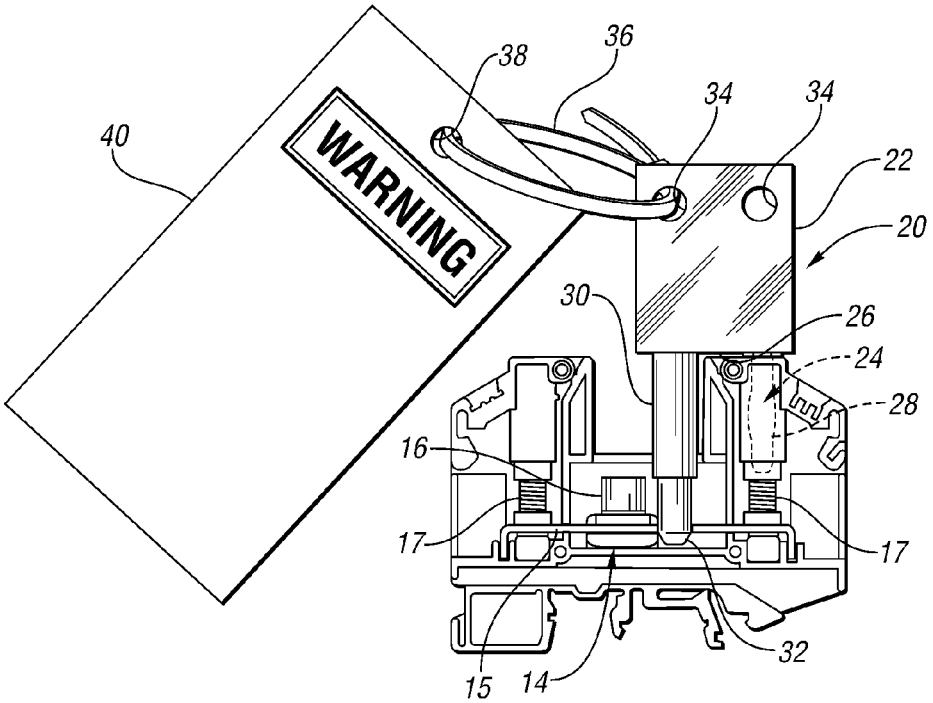
FIG. 7 is a side view of an assembly constructed in accordance with at least one embodiment of the present invention; the assembly includes the device of FIG. 5 and a warning tag, both of which are configured to receive a locking strip to suspend the tag from the device.

The distal end 32 of the blocking member 30 is generally cylindrical and wherein the opening 19 is sized and shaped to allow the distal end 32 to fit into the opening 19 and block the control element 16 in its open position as shown in FIG. 7.

The pin and blocking members 24 and 30, respectively, have central axes which are substantially parallel to each other and form two prongs. The device 20 is preferably a two-pronged device wherein the block and pin members 24 and 30, respectively, are prongs of the device.

The base member 22 is preferably made of a non-conductive material such as a laminated plastic material having a trade name of Micarta. The blocking member 30 and the base member 22 are preferably integrally formed by machining the laminated plastic material.

Figure 6:
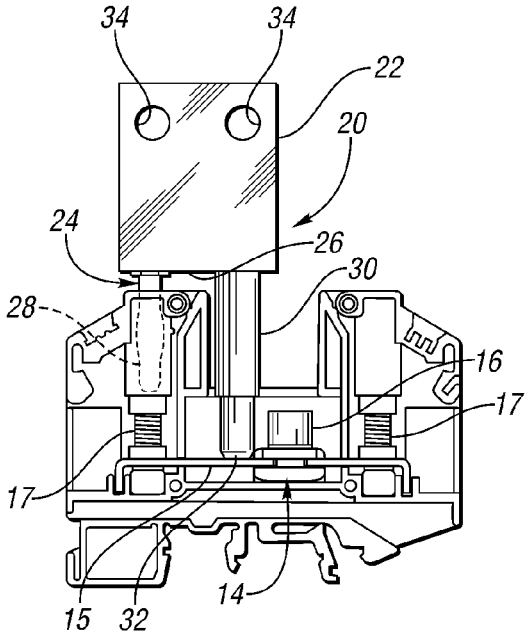
FIG. 6 is a side view of the device of FIG. 5 incorrectly installed in the block of FIG. 4 wherein the device cannot be completely inserted into the block.

As shown in FIGS. 5-7, the base member 22 typically includes at least one and preferably two apertures 34 extending completely therethrough to receive a plastic locking strip 36. The locking strip 36 extends through a hole 38 formed through a tag 40 which provides a visual warning that a circuit electrically coupled to the block 10 has been de-energized and should not be energized. The tag 40 may also have other information placed thereon.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A lockout and tagging device for a switchable energy isolation device, the isolation device having a female receptacle and a movable actuator for switching the isolation device between isolating and non-isolating states, the lockout and tagging device comprising:

a base member configured to support a tag;

a male member extending from the base member and including a portion complementary to the receptacle to retain the male member in the female receptacle after insertion of the male member into the female receptacle; and a blocking member extending from the base member, the blocking member positively blocking the actuator from moving and switching the isolation device into its non-isolating state when the male member is retained in the female receptacle, wherein a circuit coupled to the isolation device is positively de-energized when the actuator is blocked in the isolating state of the isolation device by the blocking member.

2. The device as claimed in claim 1, wherein the female receptacle includes a banana-type jack having a conductive sleeve with an internal bore and the male member is a banana-type plug to provide a low-resistance compression fit with the jack.

3. The device as claimed in claim 1, wherein the actuator includes a control element slidable on a track having an opening and wherein a distal end of the blocking member extends into the opening to block the control element from moving from an open position to a closed position of the control element.

4. The device as claimed in claim 3, wherein the distal end of the blocking member is generally cylindrical and wherein the opening is sized and shaped to allow the distal end to fit into the opening and block the control element in the open position.

5. The device as claimed in claim 1, wherein the male and blocking members have central axes which are substantially parallel to each other.

6. The device as claimed in claim 1, wherein the base and blocking members are made of a non-conductive material.

7. The device as claimed in claim 1, wherein the blocking member is made of a laminated plastic material.

8. The device as claimed in claim 7, wherein the blocking member and the base member are integrally formed from the laminated plastic material.

9. The device as claimed in claim 1, wherein the device is a two-pronged device and wherein the blocking and male members are prongs of the device.

10. The device as claimed in claim 1, wherein the base member includes at least one aperture extending completely therethrough to receive a locking strip.

11. A lockout and tagging assembly for a switchable, energy isolation device, the device having a female receptacle and a moveable actuator for switching the isolation device between isolating and non-isolating states, the assembly comprising:

a warning tag;

a base member to suspend the tag;

a male member extending from the base member and including a retaining portion complementary to the receptacle to retain the male member in the female receptacle after insertion of the male member into the female receptacle; and a blocking member extending from the base member, the blocking member positively blocking the actuator from moving and switching the isolation device into its non-isolating state when the male member is retained in the female receptacle, wherein a circuit coupled to the isolation device is positively de-energized when the actuator is blocked in the isolating sate of the isolation device by the blocking member and wherein the tag provides a visual warning that the circuit has been de-energized and should not be energized.

12. The assembly as claimed in claim 11, wherein the female receptacle includes a banana-type jack having a conductive sleeve with an internal bore and the male member is a banana-type plug to provide a low-resistance compression fit with the jack.

13. The assembly as claimed in claim 11, wherein the actuator includes a control element slidable on a track having an opening and wherein a distal end of the blocking member extends into the opening to block the control element from moving from an open position to a closed position of the control element.

14. The assembly as claimed in claim 13, wherein the distal end of the blocking member is generally cylindrical and wherein the opening is sized and shaped to allow the distal end to fit into the opening and block the control element in the open position.

15. The assembly as claimed in claim 11, wherein the male and blocking members have central axes which are substantially parallel to each other.

16. The assembly as claimed in claim 11, wherein the base and blocking member are made of a non-conductive material.

17. The assembly as claimed in claim 11, wherein the blocking member is made of a laminated plastic material.

18. The assembly as claimed in claim 17, wherein the blocking member and the base member are integrally formed from the laminated plastic material.

19. The assembly as claimed in claim 11, wherein the base member has at least one aperture extending completely therethrough to receive a locking strip, the locking strip suspending the tag from the base member.

20. A lockout and tagging device for a switchable terminal block, the block having a female receptacle with a pin-receiving internal bore and a switch that is actuated by moving a control element from an open position to a closed position, the device comprising:

a base member configured to support a tag;

a male pin member extending from one end of the base member and including at least one radially-resilient conductor portion complementary to the internal bore to lock the pin member in the female receptacle after insertion of the pin member into the female receptacle; and an electrically-insulating blocking member extending from the one end of the base member, the blocking member positively blocking the control element from moving from the open position to the closed position when the pin member is locked in the female receptacle, wherein a circuit electrically coupled to the terminal block is positively de-energized when the control element is blocked in the open position.

* * * * *

UNITED STATES PATENT AND TRADEMARK OFFICE

CERTIFICATE OF CORRECTION

PATENT NO. : 9,059,533 B2
APPLICATION NO. : 13/965676
DATED : June 16, 2015
INVENTOR(S) : Edward Bogart et al.

It is certified that error appears in the above-identified patent and that said Letters Patent is hereby corrected as shown below:

In the Claims

Column 7, Line 28, Claim 11:

After "in the isolating"
Delete "sate" and
Insert -- state --.

Signed and Sealed this
Tenth Day of November, 2015

Michelle K. Lee

Michelle K. Lee
*Director of the United States Patent and Trademark Office*